United States Patent [19]

Johansson et al.

[11] 4,397,418

[45] Aug. 9, 1983

[54] CONTROL UNIT FOR CENTRAL HEATING SYSTEMS

[75] Inventors: Lars S. Johansson, Vadstena; Bert S. Nordqvist, Motala, both of Sweden

[73] Assignee: Vadstena Pumpar AB, Vadstena, Sweden

[21] Appl. No.: 131,794

[22] Filed: Mar. 19, 1980

[30] Foreign Application Priority Data

Mar. 20, 1979 [SE] Sweden ..... 7902489

[51] Int. Cl.[3] ..... F04B 21/02; F24D 3/00

[52] U.S. Cl. ..... 237/59; 237/8 C; 137/565; 137/563; 137/337

[58] Field of Search ..... 237/63, 8 C, 59; 137/560, 562, 563, 565, 337; 285/53

[56] References Cited

U.S. PATENT DOCUMENTS 3,124,424 3/1964 Hartley et al. ..... 285/53

3,934,609 1/1976 Haggquist ..... 137/563

*Primary Examiner*—Albert J. Makay

*Assistant Examiner*—Henry Bennett

*Attorney, Agent, or Firm*—Laff, Whitesel, Conte & Saret

[57] ABSTRACT

The invention relates to a control unit comprising two bodies, one of which is located in a main fluid-distributing section, such as a hot water heating system. A shunt valve in this main section body provides for shunting the hot water, of a boiler in the main section, between different channels which are enclosed within the two bodies. The second body section is located in a group flow-distributing section, and may be used in conjunction with a circulating pump. The two bodies are connected to each other via a mechanical heat-blocking device, made of a material having a heat conductivity figure which is lower than $\lambda = 1.00$ kcal/m h °C. This heat-blocking device also establishes a communication for fluid flow between the channels, enclosed in the two bodies.

7 Claims, 4 Drawing Figures

CONTROL UNIT FOR CENTRAL HEATING SYSTEMS

The present invention relates to a fluid flow control unit, especially —although not exclusively—well-suited for use in central hot water heating systems.

An object of the invention is to enable the production of a simple and handy unit for controlling the flow of a fluid in a closed circuit, such as a hot water heating system. Here, a further object is to provide a low-cost unit which may be installed directly in an existing system of pipes near an object which is to be controlled.

Another and important object of the invention is to prevent unintentional heat leakage from a body containing a shunt valve for shunting hot water of a main distributing section into a group distributing section.

According to an aspect of the invention, these and other objects are accomplished by a unit having two bodies, enclosing channels for completing the fluid flow. One body also includes a shunt valve for shunting hot water within a main fluid-distributing section. The other body provides for connections to a group fluid-distributing section and may be used in conjunction with a circulating pump. Each body has openings for making connections with flow and return pipes of the respective fluid-distributing sections. The two bodies are connected to each other via a mechanical heat-blocking device, which is made of a material having a low heat conductivity FIGURE (e.g., lower than $\lambda=1.00$ kcal/m h °C.). The channels of one body are connected to the channels of the other body via this connection between the two bodies.

A control unit embodying the invention will now be described, by way of example, with reference to the accompanying drawings, in which.

Figure 1:
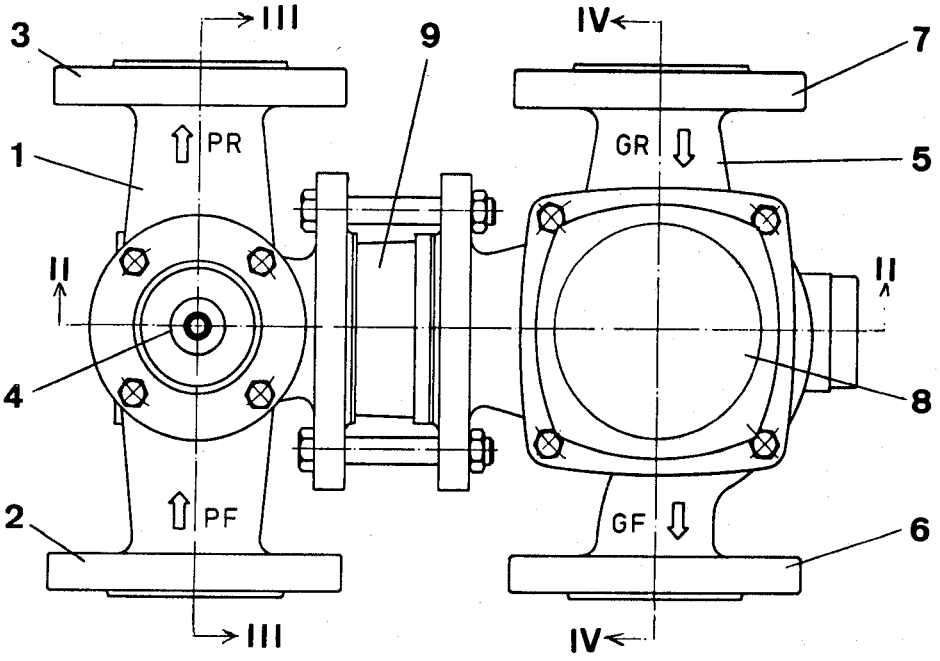
FIG. 1 is a front view of the control unit.

In the drawings, reference numeral 1 designates a body, preferably made by a moulding process. The body 1 includes flanges having openings 2 and 3. The opening 2 associated with a flange forms an inlet port for making a connection with the flow pipe of the main distributing section. The opening 3 associated with a flange forms an outlet port for making a connection with the return pipe of the same section. This section of the main fluid-distributing system may also be called the boiler section. A shunt valve 4, which may be either a two-way or a three-way type valve, is included within body 1 for shunting the flow of the hot water from the boiler.

The valve 4 includes an upper sleeve 4A (FIG. 2) which may lower or raise to enable or prevent communication between channels 11, 12. A lower and split sleeve 4C may raise to increase or lower to decrease communication between channels 10,13. The amount of increase or decrease depends upon the contours of a split section in sleeve 4C. The enlarged member 4B may seat itself in its lowermost position to block completely any communication between channels 10,13. At intermediate positions, the valve 4 mixes the fluids in the various channels in proportions which relate to the valve position.

The reference numeral 5 designates a second body, which is also preferably made by a moulding process and includes flanges having openings 6 and 7. The opening 6 provides an inlet for making a connection to the flow pipe of the group fluid-distributing section. The opening 7 provides an outlet for a circulating pump 8 which is also included within the body 5 for driving fluid in the associated group fluid-distributing section.

The two bodies 1 and 5 are connected to each other via a mechanical heat-blocking device, generally designated by the reference numeral 9, and made of a material having a low heat conductivity figure, i.e., lower than $\lambda=1.00$ kcal/m h °C., and preferably lower than $\lambda=0.30$ kcal/m h °C.

Figure 2:
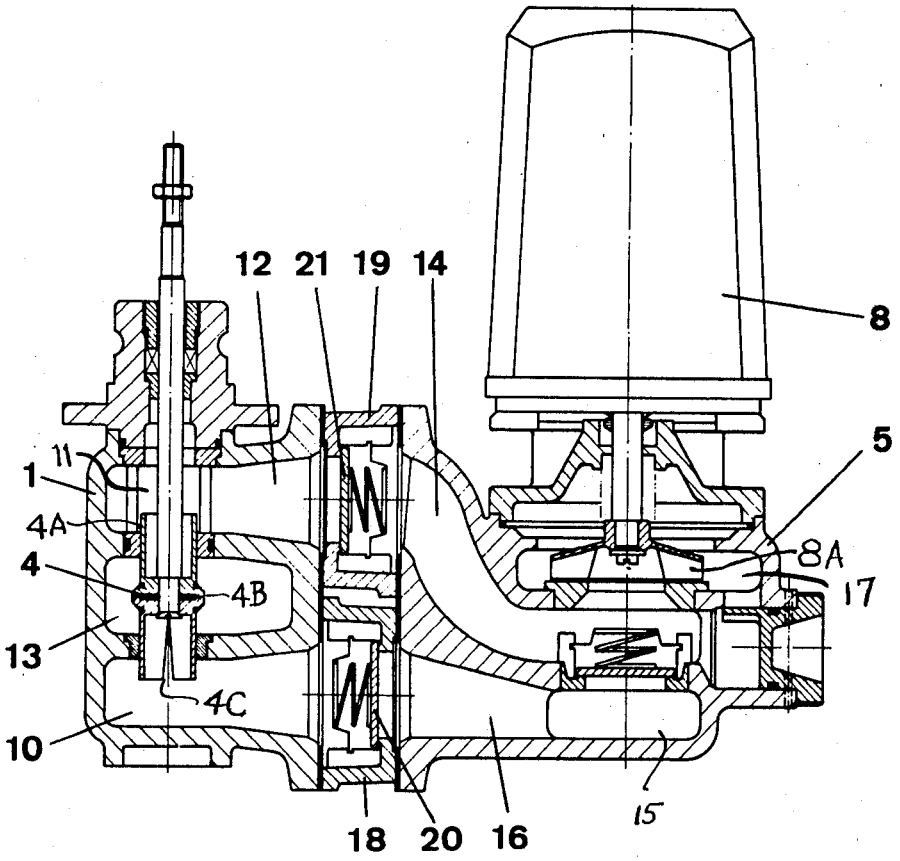
FIG. 2 is a sectional, side elevation view taken in the direction of the arrows II—II in FIG. 1.
Figure 3:
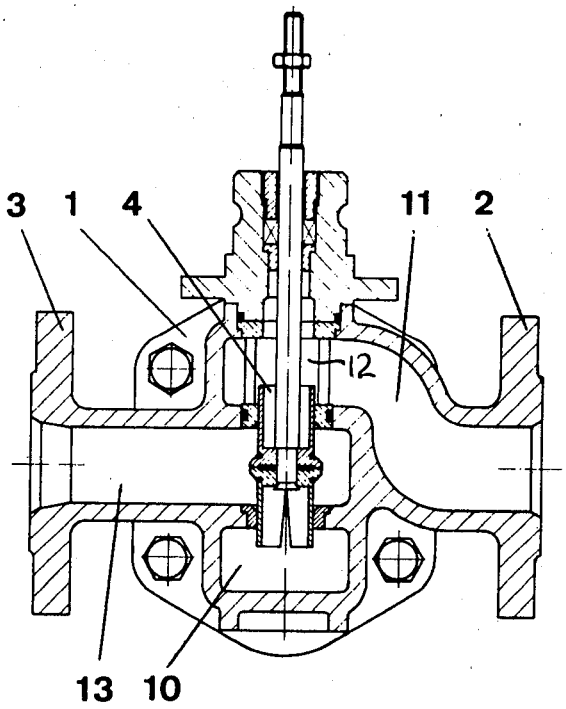
FIG. 3 is a sectional side elevation view taken in the direction of the arrows III—III in FIG. 1.
Figure 4:
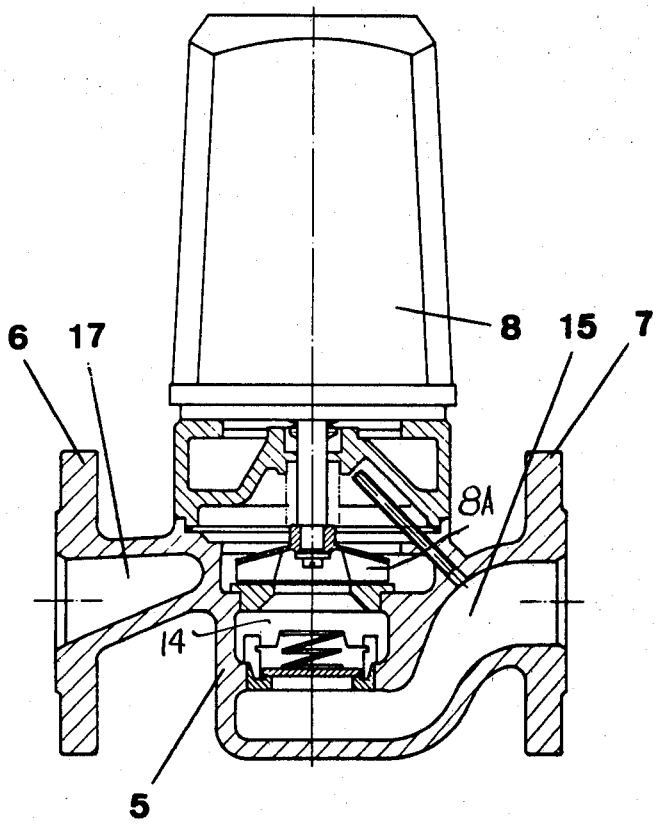
FIG. 4 is a sectional side elevation view taken in the direction of the arrows IV—IV in FIG. 1.

The bodies 1 and 5 have a number of enclosed channels, which can be seen in FIGS. 2–4. Thus, the body 1 has two channels 10 and 11 for the inlet and two channels 12 and 13 for the outlet. The body 5 has two suction channels 14 and 15 and two pressure channels 16 and 17.

The impeller 8A of the pump 8 sucks the return water of the group fluid-distributing section through the opening 7 of the body 5 and into the channels 15 and 16 from which it is discharged into channel 10 of body 1, valve 4, and into the channel 13 of the same body 1. There, the return water is mixed with the hot water, which flows through the inlet opening 2, channel 11 and valve 4 into the channel 13. The mixed water is discharged through the opening 3 of the body 1. Part of the hot water, passing in through the opening 2, also flows via the channels 11 and 12 into the channel 13,10, from which the impeller 8A of the pump 8 discharges the hot water through the channel 17, and the opening 6.

Part of the return water of the group fluid-distributing section connected to second body 5 flows directly through the opening 7, the channel 15, the pump 8 and the channel 17 to the opening 6.

If the valve 4 in FIG. 3 is completely closed, all hot water flow directly from the opening 2 via the channels 11 and 13 to the opening 3. All return water of the group fluid-distributing section flows from the opening 7 via the channel 15, the pump 8 and the channel 17 to the opening 6. In other cases, the proportions of mixture of the hot water and return water is entirely dependent of the adjustment of the valve 4.

FIG. 2 shows how the mechanical heat-blocking device may be made. A non-return valve is inserted between the two channels 12 and 14 of the respective bodies 1 and 5 and also between the two channels 10 and 16 of the same bodies. These valves form the mechanical heat-blocking device. For this purpose, the valve housing 18,19 and the spring-biased, one-way valve discs 20,21 are made of a material having the low conductivity figures mentioned above. For instance, the parts may be made of plastic or composites. The material is non-metallic and non-crystalline, because metallic and crystalline materials have heat conductivity figures which are too high.

According to the invention, the mechanical heat-blocking device makes it possible to prevent undesired heat transfer from the body 1 of the main distributing section to body 5 of the group distributing section.

To further improve the blocking of the heat transfer between the two bodies, they themselves can be made of a material having the same low heat conductivity that is stated above for the heat-blocking device.

Those who are skilled in the art will readily perceive how to modify the system. Therefore, the appended claims are to be construed to cover all equivalent structures which fall within the true scope and spirit of the invention.

We claim:

1. A fluid flow control unit for central heating systems, said unit comprising two independent bodies, shunt valve means in one of said bodies for selectively shunting fluid in a main fluid-distributing section, circulating pump means in the other body for distributing said fluid to a group fluid-distributing section, each of said independent bodies having inlet and outlet openings for connecting flow and return pipes of the respective fluid-distributing sections thereto, channel means enclosed within each of said bodies, and means for mechanically interconnecting said two independent bodies via a mechanical heat-blocking means made of a material having a heat conductivity figure which is lower than $\gamma = 1.00$ kcal/m h °C., said interconnection of the two bodies connecting the channels of the first body to the channels of the second body.

2. A fluid flow control unit for central heating systems, said unit comprising two independent bodies, shunt valve means in one of said bodies for selectively shunting fluid in a main fluid-distributing section, circulating pump means in the other body for distributing said fluid to a group fluid-distributing section, each of said independent bodies having inlet and outlet openings for connecting flow and return pipes of the respective fluid-distributing sections thereto, channel means enclosed within each of said bodies, and means comprising non-return valves in a mechanical heat-blocking means for mechanically interconnecting said two independent bodies, said mechanical heat-blocking means being made of a material having a heat conductivity figure which is lower than $\lambda = 1.00$ kcal/m h °C., said interconnection of the two bodies connecting the channels of the first body to the channels of the second body.

3. The control unit according to either claim 1 or claim 2, wherein the heat-blocking means is made of a material having a heat conductivity figure lower than $\lambda = 0.30$ kcal/m h °C.

4. The control unit according to either claim 1 or claim 2, wherein said two bodies are made of a material having the low heat conductivity figure of the heat-blocking means.

5. Fluid flow control means comprising two independent bodies, a pair of inlet means and a pair of outlet means in said two bodies being interconnected by a fluid channel between said two independent bodies, said interconnecting channel having a heat barrier means therein, said heat barrier means comprises a pair of non-metallic, non-crystalline, one-way valves positioned in said channels, means for connecting one fluid flow distributing system to said fluid flow control means via a first of said inlets and a first of said outlets, means for connecting a second fluid flow distributing system to said fluid flow control means via a second of said inlets and a second of said outlets, said heat barrier means having a heat conductivity characteristic $\lambda = 1.00$ kcal/m h °C. or less.

6. The fluid flow control means of claim 5 and means associated with one associated pair of said inlets and outlets for selectively controlling the proportion of mixture between the fluids in the first and second fluid flow distributing systems.

7. The fluid flow control means of claim 5 and means associated with one associated pair of said inlets and outlets for driving fluid through one of said fluid flow distributing systems.

* * * * *